US011699419B2

(12) United States Patent
Kwok

(10) Patent No.: US 11,699,419 B2
(45) Date of Patent: Jul. 11, 2023

(54) LIGATURE FOR A WOODWIND INSTRUMENT

(71) Applicant: Chi Loi Clark Kwok, Kowloon (HK)

(72) Inventor: Chi Loi Clark Kwok, Kowloon (HK)

( * ) Notice: Subject to any disclaimer, the term of this patent is extended or adjusted under 35 U.S.C. 154(b) by 0 days.

(21) Appl. No.: 17/705,759

(22) Filed: Mar. 28, 2022

(65) Prior Publication Data

US 2022/0310042 A1 Sep. 29, 2022

(30) Foreign Application Priority Data

Mar. 26, 2021 (GB) ..... 2104333

(51) Int. Cl.
*G10D 9/02* (2020.01)
*G10D 9/08* (2020.01)

(52) U.S. Cl.
CPC ..... *G10D 9/02* (2013.01); *G10D 9/08* (2020.02)

(58) Field of Classification Search
CPC .. G10D 9/02; G10D 9/08; G10D 7/06; G10D 7/00; G10D 9/00
See application file for complete search history.

(56) References Cited

U.S. PATENT DOCUMENTS 6,020,545 A 2/2000 Consoli
2012/0266736 A1* 10/2012 Rovner ..... G10D 9/02 84/383 R

* cited by examiner

*Primary Examiner* — Kimberly R Lockett
(74) *Attorney, Agent, or Firm* — Young Basile Hanlon & MacFarlane, P.C.

(57) ABSTRACT

A woodwind instrument ligature comprises a plurality of ligature bodies; each body having first and second ends; an aperture extending through each end; the apertures at each first end being coaxial and the apertures at each second end being coaxial; a first tensioning member located in the apertures of the first ends and a second tensioning member located in the apertures of the second ends; each tensioning member having a transversely extending bore, a fixing member extending through the bores of the tensioning members, the fixing member being adjustable to urge the tensioning members together or apart; wherein the ligature body comprises a flexible material having a length to wrap around a mouthpiece and reed for a musical instrument to form a channel to receive the mouthpiece and reed, with the tensioning members being connected by the fixing member in use; each end having first and second contact surfaces; wherein each end may be rotated about the tensioning member between first and second positions; wherein in the first position, the first contact surface faces inwardly toward the channel and the second contact surface faces outwardly in use and wherein in the second position, the second contact surface faces inwardly and the first contact surface faces outwardly from the channel in use.

13 Claims, 7 Drawing Sheets

LIGATURE FOR A WOODWIND INSTRUMENT

CROSS-REFERENCE TO RELATED APPLICATION(S)

This application claims priority to United Kingdome Application Patent Serial No. GB2104333.6, filed Mar. 26, 2021, the entire disclosure of which is hereby incorporated by reference.

TECHNICAL FIELD

This invention relates to a ligature for the mouthpiece of a musical instrument, in which the ligature is used to removably secure a reed to the mouthpiece. The invention relates particularly, but not exclusively, to a ligature used to secure a reed to the mouthpiece of a saxophone, clarinet or other woodwind instrument.

BACKGROUND

Conventional ligatures comprise an inelastic band, for example, a metal band, which passes around a cylindrical mouthpiece and reed in use, wherein the ligature may be tightened by a screw-threaded arrangement to secure the reed, the arrangement being adjustable to control the force supplied to the reed so the reed is firmly secured against a table of the mouthpiece while allowing the reed to vibrate freely in use.

Mouthpieces of reed instruments, for example, alto and tenor saxophones, have different sizes, so that a musician may need to have a differently sized ligature for each instrument.

U.S. Pat. No. 6,020,545 discloses a ligature for a clarinet or saxophone containing a plastic insert or ramp which is riveted to the ligature by plastic rivets so that the size of the ramp may be adjusted to accommodate different sizes of woodwind reeds.

It is an object of the present invention to provide a ligature which may be used with differently sized mouthpieces and which may be easily interchanged without a need to be dismantled and reassembled.

SUMMARY

According to the present invention, a woodwind instrument ligature comprises a plurality of ligature bodies;

each body having first and second ends;

an aperture extending through each end;

the apertures at each first end being coaxial and the apertures at each second end being coaxial;

a first tensioning member located in the apertures of the first ends and a second tensioning member located in the apertures of the second ends;

each tensioning member having a transversely extending bore, a fixing member extending through the bores of the tensioning members, the fixing member being adjustable to urge the tensioning members together or apart;

wherein the ligature body comprises a flexible material having a length to wrap around a mouthpiece and reed for a musical instrument to form a channel to receive the mouthpiece and reed, with the tensioning members being connected by the fixing member in use;

each end having first and second contact surfaces;

wherein each end may be rotated about the tensioning member between first and second positions;

wherein in the first position, the first contact surface faces inwardly toward the channel and the second contact surface faces outwardly in use and wherein in the second position, the second contact surface faces inwardly and the first contact surface faces outwardly from the channel in use.

The ligature body may be reversible without disconnecting the tensioning members from the ligature body.

Preferably two ligature bodies are employed. These may be separate or connected together.

A ligature in accordance with this invention is reversible so that the inwardly facing contact surface may be alternatively selected from the first and second contact surfaces.

Preferably the ends are rotated about the tensioning member between the first and second positions.

A head may be provided at each end of each body. The head may include the first and second contact surfaces. The apertures may extend through respective ends or heads.

The radial dimension of the first contact surface may be greater than the radial dimension of the second contact surface, relative to the axis of the tensioning member about which the head may rotate in use. This has the effect that the ligature may be engaged with differently sized mouthpieces.

Preferably the ligature body wholly comprises a flexible material.

The ligature body may be composed of flexible polymeric material, preferably an elastomeric material, preferably a silicone elastomer, natural or synthetic rubber. The ligature body may be substantially inextensible in use. The material used to form the ligature body may be selected in accordance with desired acoustic properties of the instrument.

In preferred embodiments, the ligature comprises two bodies. The bodies may be joined together by the tensioning members, the two tensioning members being adjustably connected by the fixing member.

In an alternative embodiment, the bodies are joined together to form a unitary body structure. The contact surfaces and/or arms may be joined together to form a unitary body structure, with the ends extending from the structure.

In a further alternative embodiment, the tensioning member may be integral with the bodies, for example, being composed of the same flexible material as the bodies. In this embodiment, bores may not be provided in the ends of the bodies.

The ligature body may be U-shaped or C-shaped, having a central portion with pressure pads on inwardly and outwardly facing surfaces thereof, two arms extending from the central portion, towards a respective head, apertures in the heads extending perpendicular to the body. The apertures may extend parallel to the axis of the channel for the mouthpiece in use. The ligature body may have a generally laminar configuration.

The tensioning member may be cylindrical having a transverse bore located at or adjacent a midpoint thereof. The bore may be threaded or unthreaded.

The fixing member may comprise a cylindrical shaft with a head and a threaded end, with which a fixing nut may be engaged. A nut and bolt arrangement may be employed.

The pressure pads may each comprise one or more raised contact regions. The regions may comprise projections.

The projections may be configured to form generally part-cylindrical surfaces when facing inwardly towards the mouthpiece in use.

The ligature of this invention confers several advantages in comparison to previously known ligatures. A single ligature, for example, comprising two parallel bodies, joined by tensioning members passing through apertures in their ends or heads, may be used to secure a variety of differently sized mouthpieces. Use of a metal body is avoided, improving the acoustic properties of the ligature. Use of flexible bodies facilitates even distribution of pressure around the circumference of the mouthpiece, ensuring secure engagement of the reed to the table of the mouthpiece. This allows a smaller force to be applied to the mouthpiece while maintaining secure engagement of the ligature body around the mouthpiece. This affords a wider range of operating pressures. The ligature may be easily removed from an instrument, the ligature body is reversed and then installed on another instrument so that a single ligature may be used on two or more instruments as may be required.

BRIEF DESCRIPTION OF THE DRAWINGS

The invention is further described by means of example, but not in any limitative sense, with reference to the accompanying drawings, of which.

Figure 1:
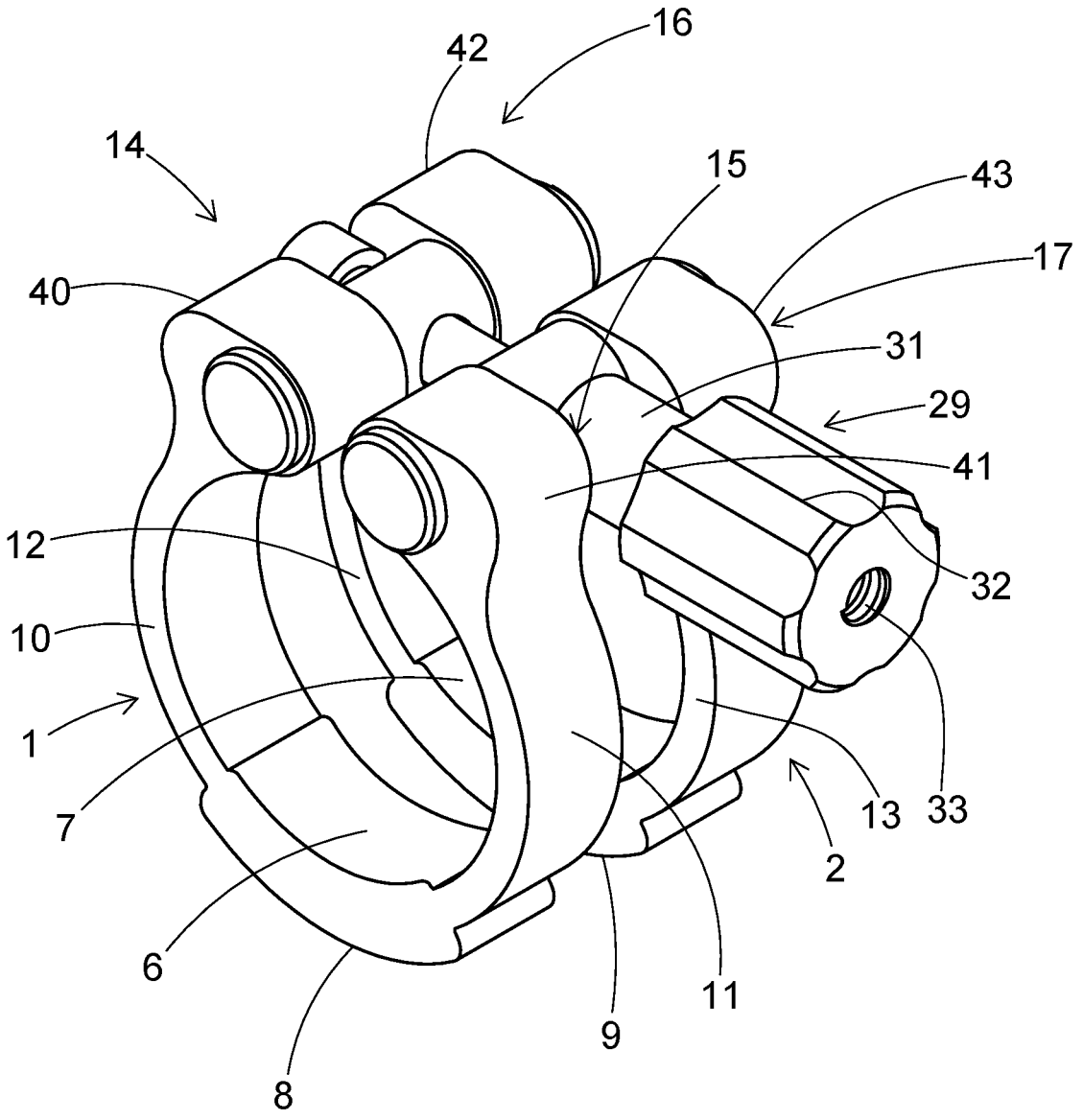
FIG. 1 is a perspective view of a ligature in accordance with this invention.
Figure 2:
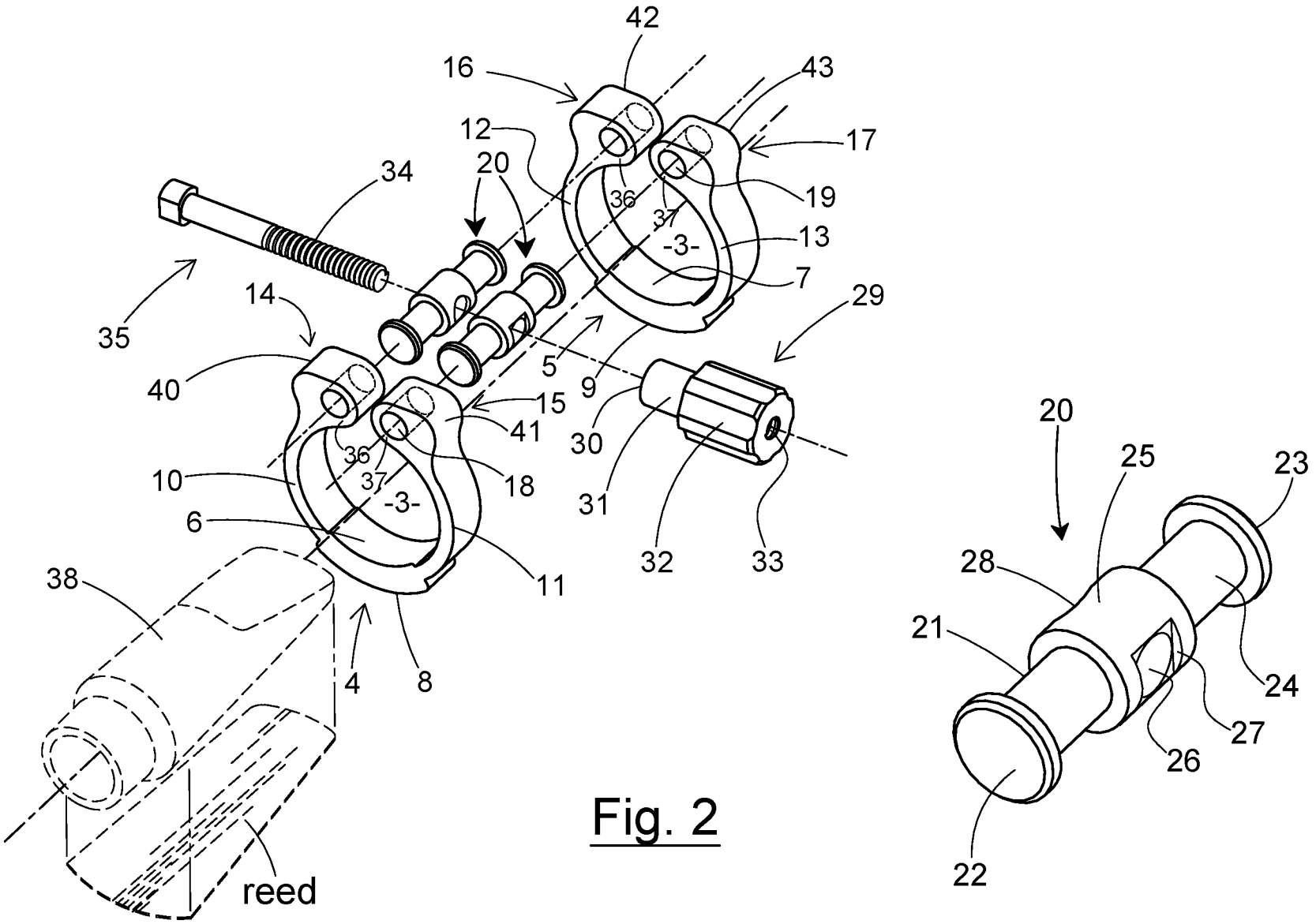
FIG. 2 is an exploded view of the ligature shown in FIG. 1.

The Figures show a ligature for a saxophone, or other woodwind instrument.

DETAILED DESCRIPTION

A pair of similar, or identical ligature bodies, (1), (2) are arranged in parallel spaced relation to form a generally cylindrical channel (3) dimensioned to receive the mouthpiece of a saxophone or other musical instrument.

Each ligature body (1), (2) comprises a central portion (4), (5) each having radially, with respect to the channel and axis of the mouthpiece in use, inwardly extending projections (6), (7) and radially outwardly extending projections (8), (9). The inwardly facing projections form a part-cylindrical surface to contact the mouthpiece in use. Each ligature body has arms (10), (11), (12), (13), respectively. Heads (14), (15), (16), (17) are formed at ends of the arms. Head (14) has a mirror image configuration to head (15) and head (16) has a mirror image configuration to head (17).

Each head includes an enlarged portion having an aperture extending between the sides thereof, for example, (18), (19) extending transversely of the body parallel to the axis of the channel (3) and the mouthpiece in use.

The first tensioning member (20) comprises axial shaft (21), (24). The shafts are cylindrical having a central collar (25) and end stops (22), (23). The end stops (22), (23) are cylindrical and have a larger diameter than the shafts (21), (24). The central collar (25) has a larger diameter than the shafts (21), (24). In a preferred embodiment, the collar and end stops have the same diameter. A transverse bore (26) extends through the collar, perpendicular to the axis of the shafts (21), (24). A fixing head (29) has a shank (31) having a face (30) extending away from a manual grip (32). A threaded bore (33) extends through the fixing head (29) and is configured to receive the threaded shank (34) of fixing member (35). The fixing member (35) comprises a bolt in the depicted embodiment. Recesses (27), (28) in the collar allow the face (30) of the shank (31) to engage fully with the tensioning member (20). The second tensioning member has the same configuration as the first tensioning member (20).

Figure 3:
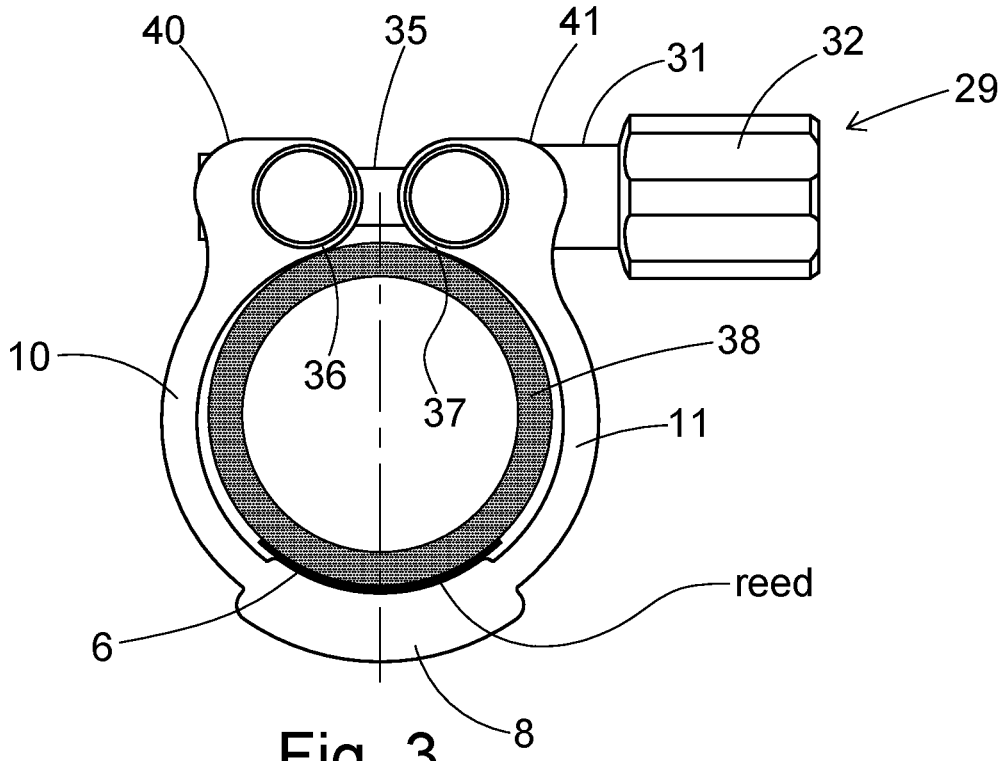
FIG. 3 is a front view of the ligature mounted on a larger diameter mouthpiece.
Figure 4:
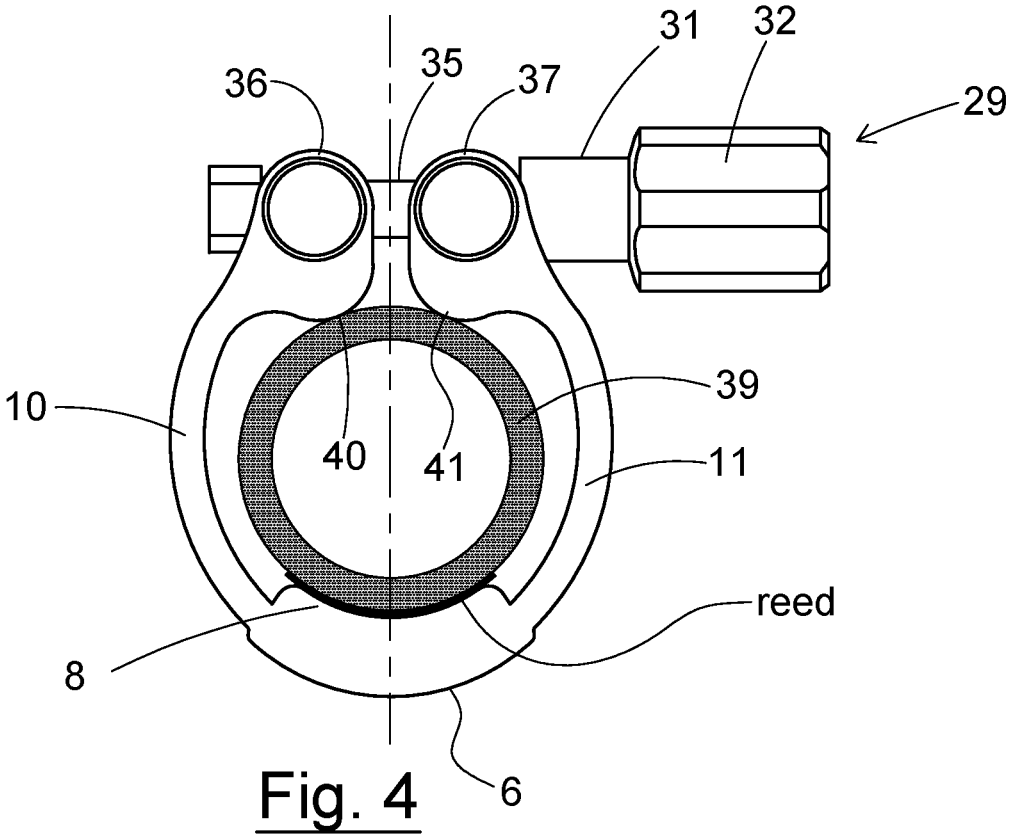
FIG. 4 is a front view of the ligature mounted on a smaller diameter mouthpiece.

The shank (34) of fixing member (35) may be inserted from either side of the ligature so that it passes through the bores (26) in both tensioning members as shown in FIGS. 3 and 4.

The heads (14), (15), (16), (17) have a similar configuration. First contact surfaces (36), (37) face inwardly into the channel (3), towards the surface of the larger diameter mouthpiece (38) in the first position as shown in FIG. 3 and face outwardly away from a smaller diameter mouthpiece (39) in the second position as shown in FIG. 4.

Second contact surfaces (40), (41), (42), (43) are formed by cam surfaces on the exterior of the respective heads (14), (15), (16), (17). The second contact surfaces have a greater radial distance from the axis of the tensioning member (20). The first and second contact surfaces each has a constant radial dimension along the axis of rotation in use.

The heads (14), (!5), (16), (17) may each rotate relative to the respective shafts (21), (24) of the tensioning member to which they are engaged. This allows the configuration of the ligature to be inverted, or turned inside out. In order to do this, the shank (34) and head (29) of the fixing member is unscrewed and removed from the bores (26). This allows the heads to be separated and the arms (10), (11), (12), (13) to be unfolded and refolded in a reverse configuration so that contact surfaces (8), (9) are facing inwardly and the second radially larger contact surfaces (40), (41), (42), (43) face inwardly toward the channel (3) in which a mouthpiece may be secured. This configuration is shown in FIG. 4. This allows a smaller diameter mouthpiece (39) and reed to be securely engaged.

The shank, (34) is then inserted into the bores (26) and the head (29) screwed onto the thread (34) to tighten the ligature and securely engage the reed to the mouthpiece.

Preferably, the heads of a ligature body have the same configuration and dimensions but are mirror images of each other.

Both of the first contact surfaces extend inwardly into the channel for the mouthpiece in a first configuration of the ligature, adapted for use with a smaller diameter mouthpiece (39), and both of the second contact surfaces face inwardly in a second configuration of the ligature adapted for use with a larger diameter mouthpiece.

In use of the ligature, the nut or finger grip, of the fixing member is unwound so that the tensioning members move apart causing the heads to move apart, increasing the width of the channel. This allows a mouthpiece and reed to be inserted or removed from the channel.

Reversal of the ligature configuration between the first and second positions is facilitated when the heads are spaced apart. This enables the ligature to pass around the heads, reversing its configuration. This enables the ligature to be adapted for use with a larger or smaller mouthpiece, as required.

When a desired mouthpiece has been inserted into the channel, the fixing member may be tightened until the mouthpiece and reed are securely engaged.

Figure 5:
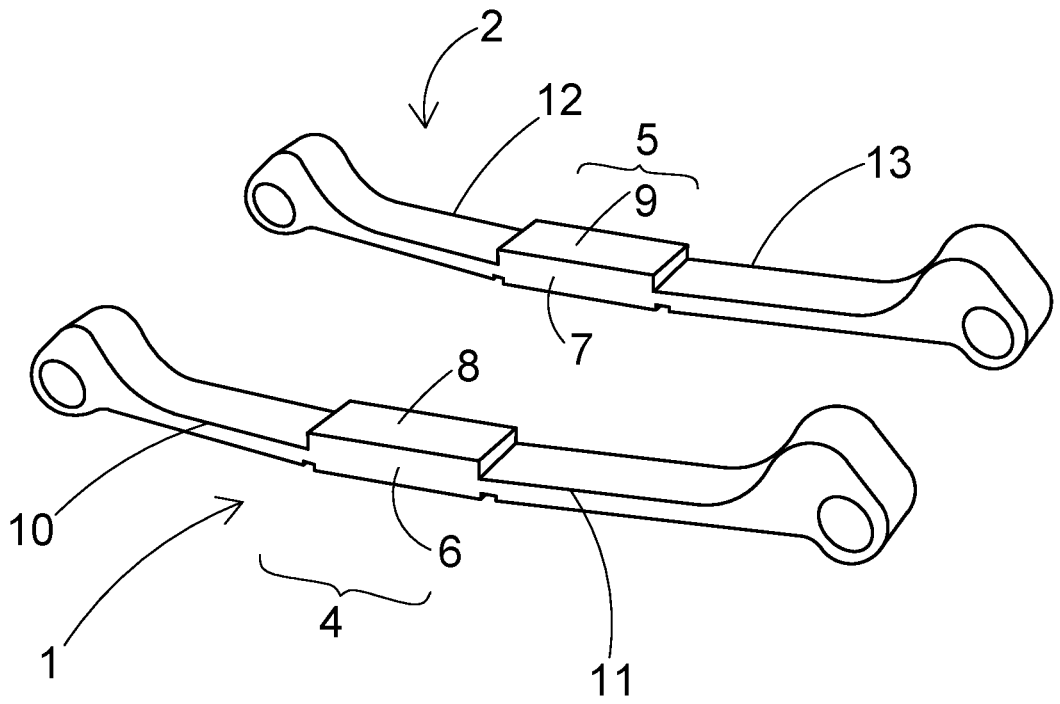
FIG. 5 shows two extended ligature bodies.

FIG. 5 shows the two ligatures with the tensioning and fixing members removed. The ligature bodies have the same component parts as described with reference to the preceding Figures.

Figure 6:
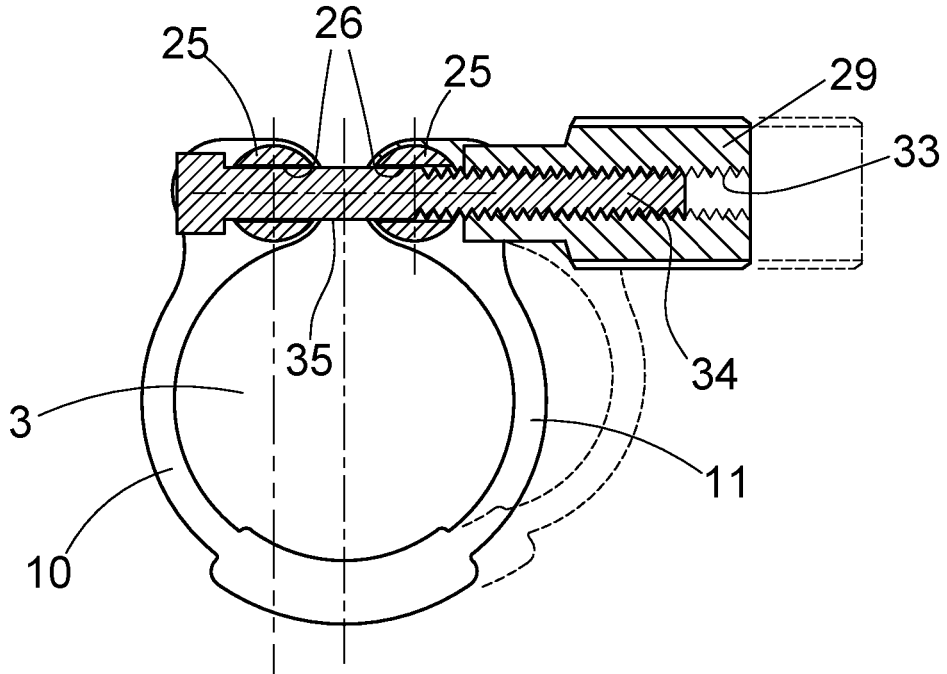
FIG. 6 is a cross sectional view of an opened configuration of the tensioning and fixing members.
Figure 7:
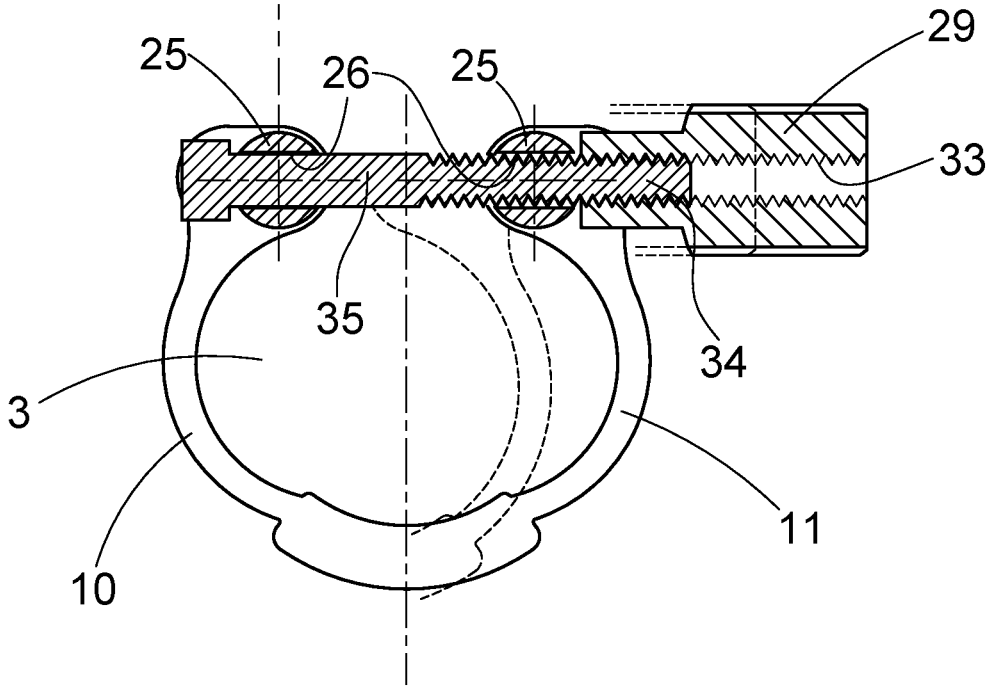
FIG. 7 shows a closed configuration of the tensioning and fixing members.

FIGS. 6 and 7 show the opening and closing of the tensioning members (20) having central collars (25) and a fixing member (35) extending through transverse bores (26) in the collars (25). A fixing head (29) has a threaded bore (33) to receive threaded shaft (34) of the fixing member (35). In FIG. 6 the fixing head (29) is screwed onto the threaded shaft to urge the tensioning members together and reducing the diameter of the channel (3) to engage the mouthpiece of a saxophone or other musical instrument.

In FIG. 7 the fixing member is unscrewed so that the channel (3) is expanded to allow removal from it of a musical instrument mouthpiece.

Figure 8:
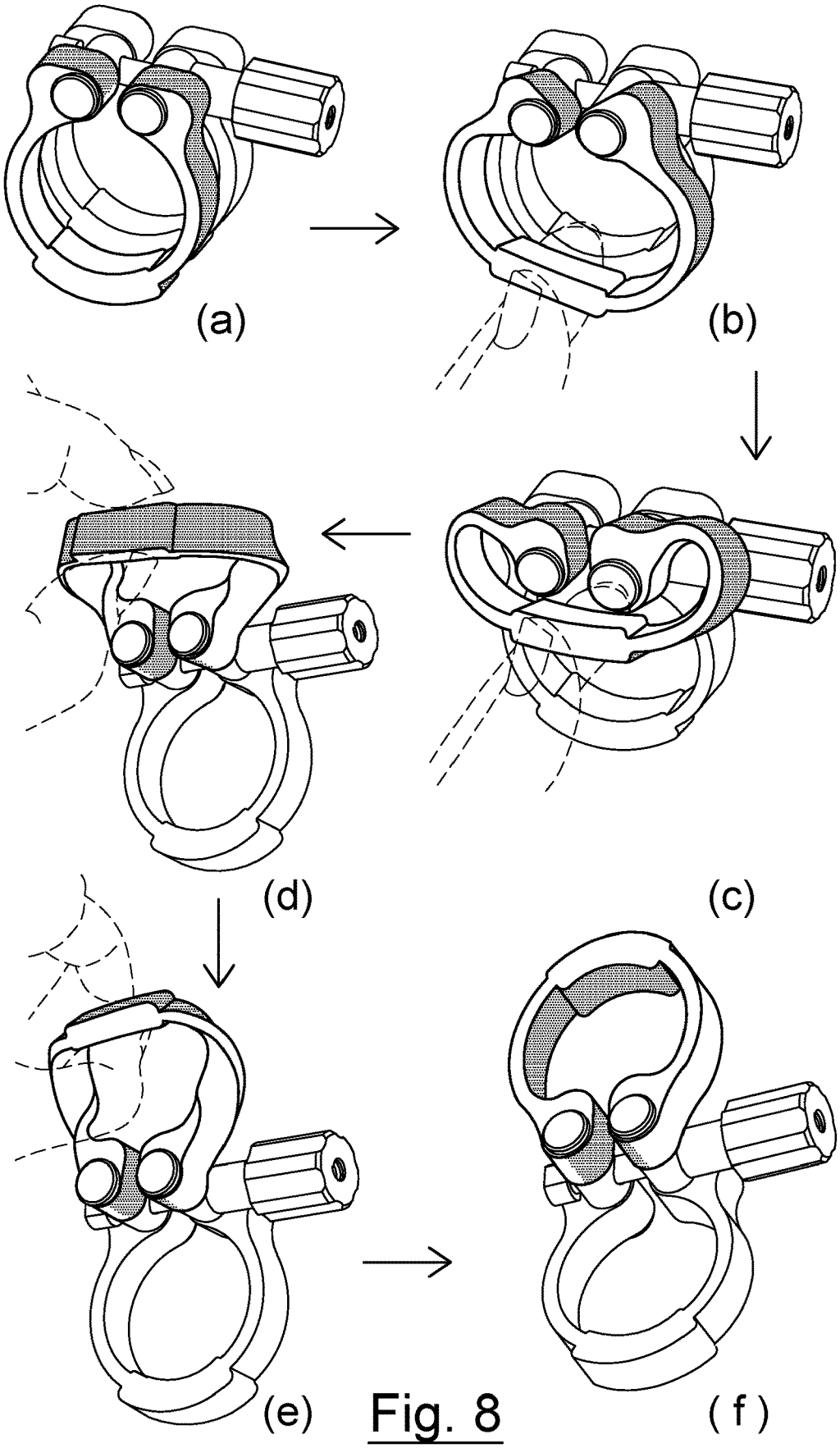
FIG. 8 shows six stages of reversing the ligature body.

FIG. 8 shows the stages of reversal of a ligature body. In FIG. 8(*a*) the initial configuration is shown. In FIG. 8(*b*) the central portion of the body is pulled outwardly upwardly to cause the heads to rotate. In FIG. 8(*c*) the central portion of the body continues to be pulled upwardly adjacent the heads and tensioning members. In FIG. 8(*d*) the central portion of the body is pulled upwardly above the tensioning and fixing members. This causes the heads to rotate around the tensioning members and the body is twisted into a reverse configuration as shown in FIG. 8(*e*). FIG. 8(*f*) shows the fully reversed ligature body. In this configuration the large heads face inwardly toward the channel (3) to accommodate smaller diameter mouthpieces.

Figure 9:
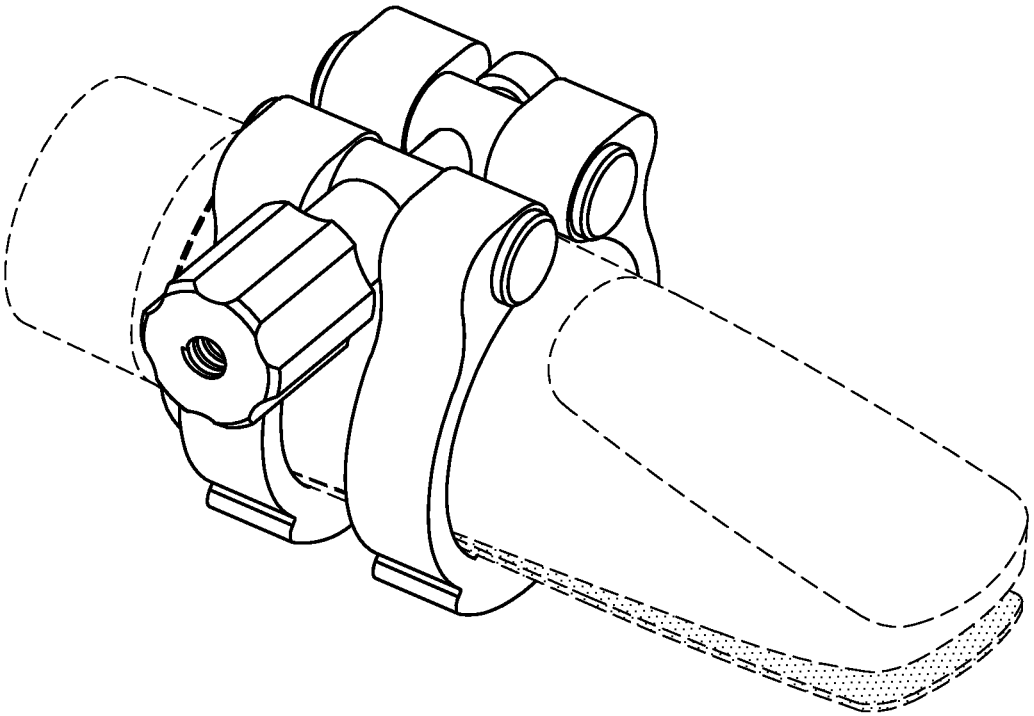
FIG. 9 shows the ligature mounted on a saxophone mouthpiece.

FIG. 9 shows the ligature fitted onto a mouthpiece and reed for a saxophone or musical instrument with the heads of the body contacting the reed to press the reed against the table of the reed.

What is claimed is:

1. A woodwind instrument ligature comprising:

a plurality of ligature bodies;

each body having first and second ends;

an aperture extending through each end;

the apertures at each first end being coaxial and the apertures at each second end being coaxial;

a first tensioning member located in the apertures of the first ends and a second tensioning member located in the apertures of the second ends;

each tensioning member having a transversely extending bore, a fixing member extending through the bores of the tensioning members, the fixing member being adjustable to urge the tensioning members toward or away from each other;

wherein the ligature body comprises a flexible material having a length to wrap around and form a channel to receive a mouthpiece and reed for a musical instrument, with the tensioning members being connected by the fixing member in use;

each end having first and second contact surfaces;

wherein each end may be rotated about the tensioning member between first and second positions;

wherein in the first position, the first contact surface faces inwardly toward the channel and the second contact surface faces outwardly in use and wherein in the second position, the second contact surface faces inwardly and the first contact surface faces outwardly from the channel in use.

2. A ligature as claimed in claim 1, wherein the ligature body is reversible so that the inwardly facing contact surface may comprise the first or second contact surface.

3. A ligature as claimed in claim 1, wherein each end comprises a head.

4. A ligature as claimed in claim 1, wherein the radial dimension of the first contact surface is greater than the radial dimension of the second contact surface.

5. A ligature as claimed in claim 1, wherein the radial dimension of the first contact surface is greater than the radial dimension of the second contact surface, relative to the axis of the tensioning member about which the end may rotate in use.

6. A ligature as claimed in claim 1, wherein the ligature body is wholly or partially composed of flexible and resilient material.

7. A ligature as claimed in claim 6, wherein the ligature body is composed of an elastomer, preferably a silicone elastomer.

8. A ligature as claimed in claim 1, comprising two ligature bodies.

9. A ligature as claimed in claim 1, wherein the bodies are joined together to form a unitary body structure.

10. A ligature as claimed in claim 8, wherein the bodies are connected by the tensioning members, the tensioning members being connected by the fixing member.

11. A ligature as claimed in claim 1, wherein the ligature body is C-shaped or U-shaped in use; the body having a central portion with pressure pads on inward and outward facing surfaces, two arms extending from the central portion each towards a respective end or head.

12. A ligature as claimed in claim 11, wherein apertures in the ends or heads extend parallel to the axis of the channel in use.

13. A ligature as claimed in claim 1, wherein the tensioning member is cylindrical, having a transverse bore.

* * * * *